US010024068B1

(12) United States Patent
Chen

(10) Patent No.: US 10,024,068 B1
(45) Date of Patent: Jul. 17, 2018

(54) BOARD ADJUSTER

(71) Applicant: Ching-Chuan Chen, Taichung (TW)

(72) Inventor: Ching-Chuan Chen, Taichung (TW)

( * ) Notice: Subject to any disclaimer, the term of this patent is extended or adjusted under 35 U.S.C. 154(b) by 0 days.

(21) Appl. No.: 15/402,605

(22) Filed: Jan. 10, 2017

(51) Int. Cl.
*E04F 21/20* (2006.01)
*E04F 21/22* (2006.01)

(52) U.S. Cl.
CPC ..... *E04F 21/20* (2013.01); *E04F 21/22* (2013.01)

(58) Field of Classification Search
CPC ..... E04F 21/20; E04F 21/22
USPC ..... 52/747.11, 747.12
See application file for complete search history.

(56) References Cited

U.S. PATENT DOCUMENTS 4,397,125 A * 8/1983 Gussler, Jr. ..... E04F 21/0092 52/127.3
5,603,195 A * 2/1997 Cosentino ..... E04F 13/0892 52/127.3
8,887,475 B2 * 11/2014 Ghelfi ..... E04F 21/0092 52/749.11
9,260,872 B2 * 2/2016 Bunch ..... E04F 21/0092
9,279,259 B1 * 3/2016 Russo ..... E04F 21/20
9,487,959 B2 * 11/2016 Bunch ..... E04F 21/1844
9,562,365 B2 * 2/2017 Bucsa ..... E04F 21/0092
2013/0055675 A1 * 3/2013 Sighinolfi ..... E04F 21/0092 52/749.11
2014/0033641 A1 * 2/2014 Trevisi ..... E04F 21/0092 52/749.1

* cited by examiner

*Primary Examiner* — Adriana Figueroa
(74) *Attorney, Agent, or Firm* — Muncy, Geissler, Olds & Lowe, P.C.

(57) ABSTRACT

A board adjuster is provided, including an adjusting member and a positioning member. The adjusting member includes a toggling portion and an insertion portion, the insertion portion has two restricting members extending oppositely, the toggling portion has two recessive portions, and the insertion portion is located between two recessive portions. The positioning member has a slot. The insertion portion is for being inserted into a gap between two boards, the positioning member is for abutting against and between the two boards and the toggling portion, the insertion portion is disposed through the slot, the positioning member is disposed through the two recessive portions, the positioning member abuts against the two recessive portions so that the two restricting members respectively abut against a side of one of the two boards away from the toggling portion.

8 Claims, 8 Drawing Sheets

BOARD ADJUSTER

BACKGROUND OF THE INVENTION

Field of the Invention

The present invention relates to a board adjuster.

Description of the Prior Art

Conventionally, when paving boards, a user uses a board adjuster to adjust the boards so that s/he can pave the boards flatly and orderly. The conventional board adjuster has an adjusting member and a positioning member, and the adjusting member and the positioning member respectively have a threaded section which are screwable with each other, the positioning member is inserted into a space between the two boards next to each other and abuts against bottom faces of the two boards, and through rotating the adjusting member and the positioning member relative to each other, the positioning member can axially ascend or descend to abut the two boards to a same plane.

However, it is costly to process the threaded sections of the adjusting member and the positioning member of the conventional board adjuster, and it is time-consuming to rotate the adjusting member and the positioning member relative to each other. When decorating a building, a great number of boards are required, and it would be time-wasting to rotate the adjusting member and the positioning member to adjust the boards.

The present invention has arisen to mitigate and/or obviate the afore-described disadvantages.

SUMMARY OF THE INVENTION

The major object of the present invention is to provide a board adjuster, which has a simple structure and a low manufacturing cost and is easy to be operated. In addition, the board adjuster can be used repeatedly, so it is environmental-friendly and cost-saving to use the board adjuster.

To achieve the above and other objects, a board adjuster is provided, including an adjusting member and a positioning member. The adjusting member includes a toggling portion and an insertion portion which are connected with each other, an end of the insertion portion opposite to the toggling portion has two restricting members which extend toward directions opposite to each other, an end of the toggling portion near the two restricting members has two recessive portions, each said recessive portion has a bottom side and a lateral side, and the insertion portion is located between two recessive portions. The positioning member has a slot, the two recessive portions correspond to the positioning member in shape, and the positioning member has a top portion and two side walls. The insertion portion is for being inserted into a gap between two boards which are next and parallel to each other, the positioning member is for abutting against and between the two boards and the toggling portion, the insertion portion is disposed through the slot, the positioning member is disposed through the two recessive portions, the top portion abuts against the bottom sides of the two recessive portions, and the two side walls respectively abut against the lateral sides of the two recessive portions so that the two restricting members respectively abut against a side of one of the two boards away from the toggling portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
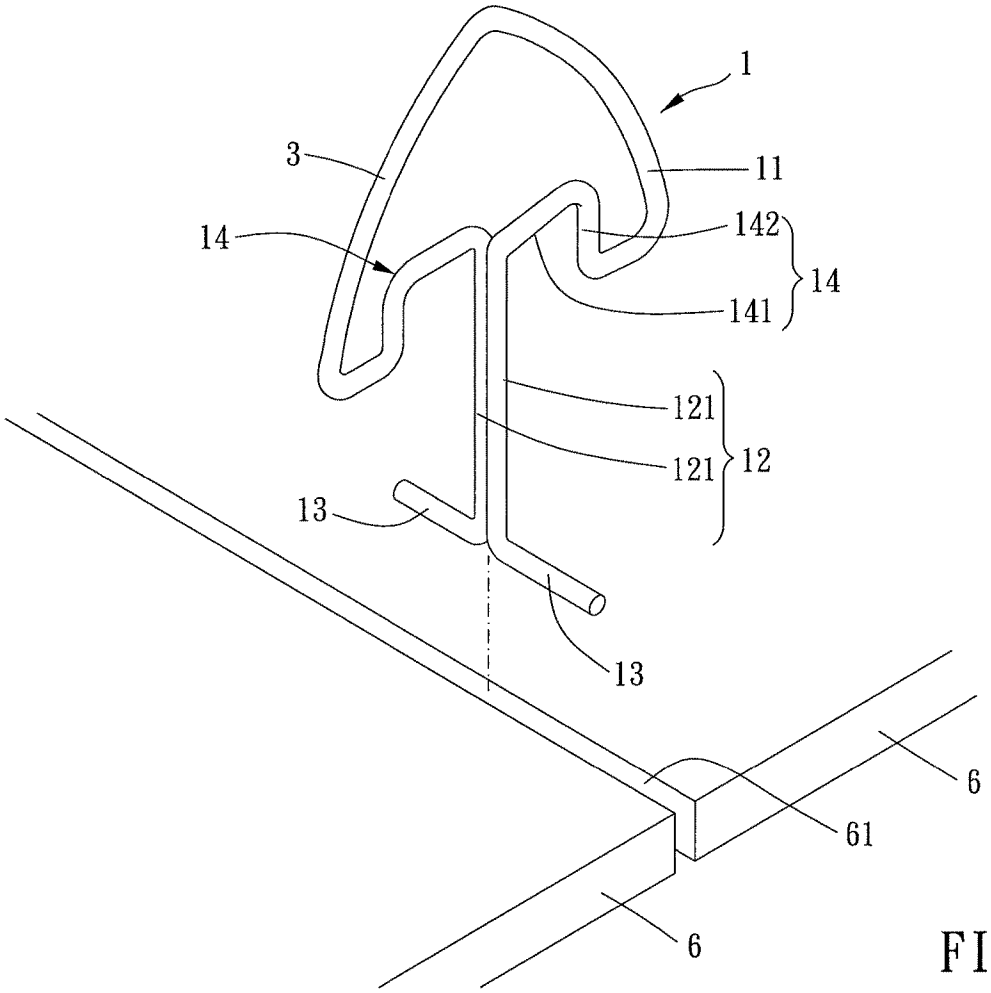
FIGS. 1 and 2 are stereograms of a preferred embodiment of the present invention.
Figure 3:
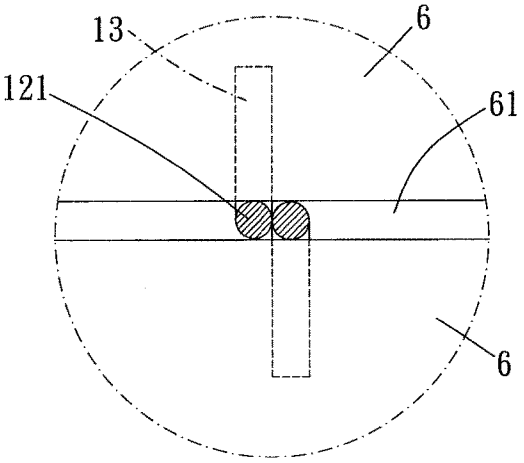
FIG. 3 is a cross-sectional top view of FIG. 2.
Figure 2:
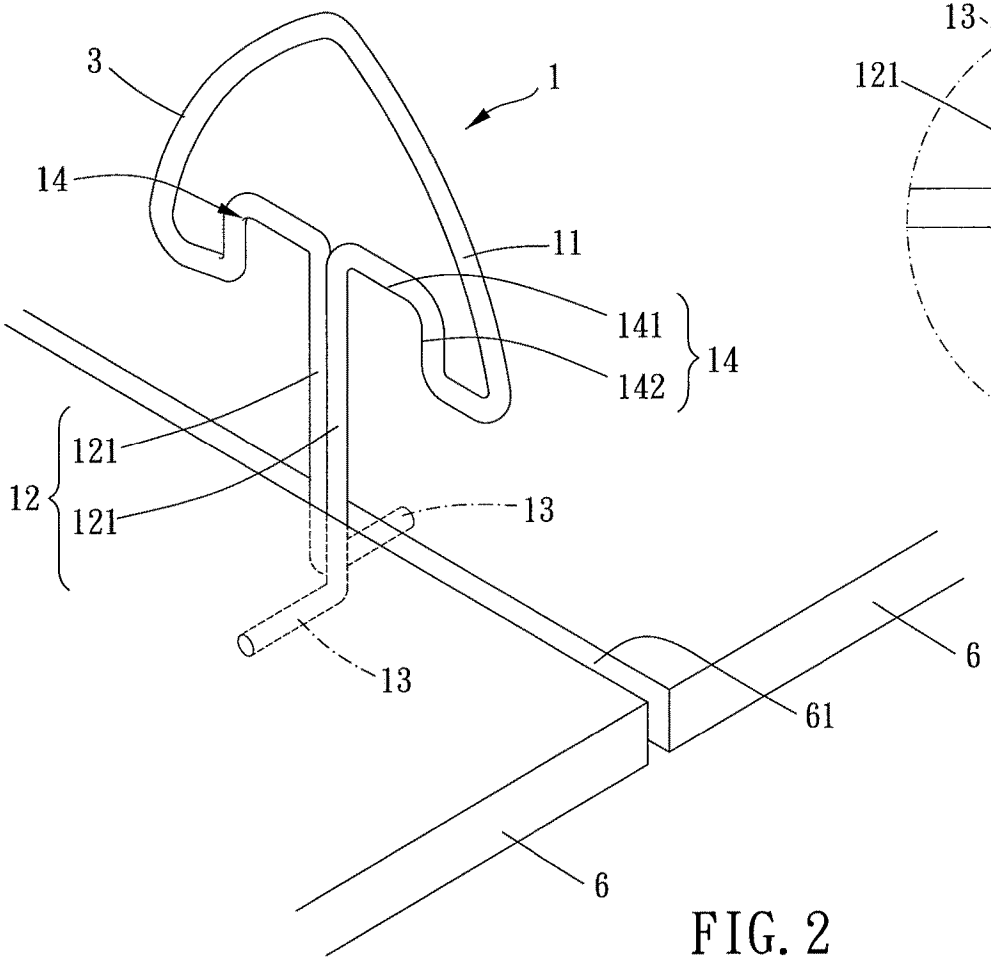
Figure 4:
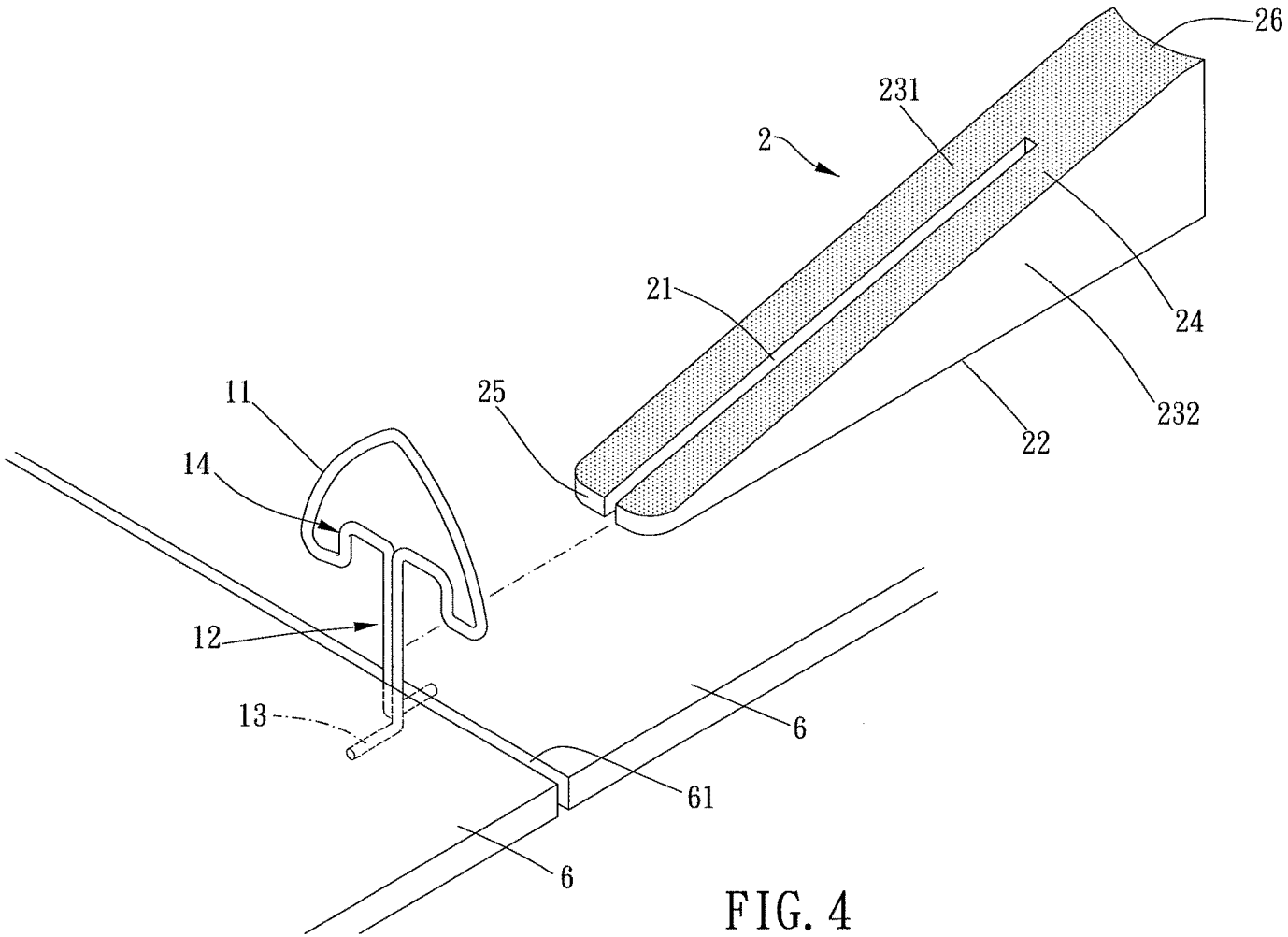
FIGS. 4 and 5 are drawings of the preferred embodiment of the present invention in operation.
Figure 5:
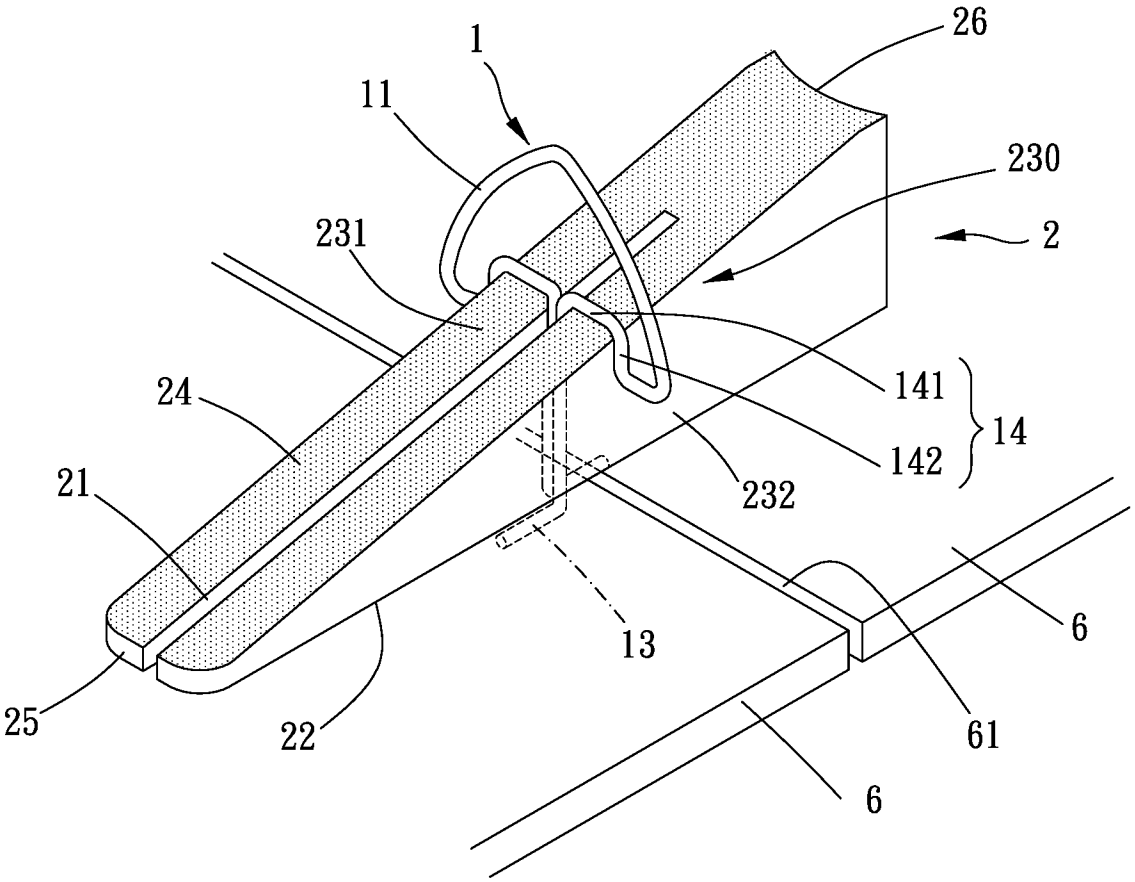
Figure 6:
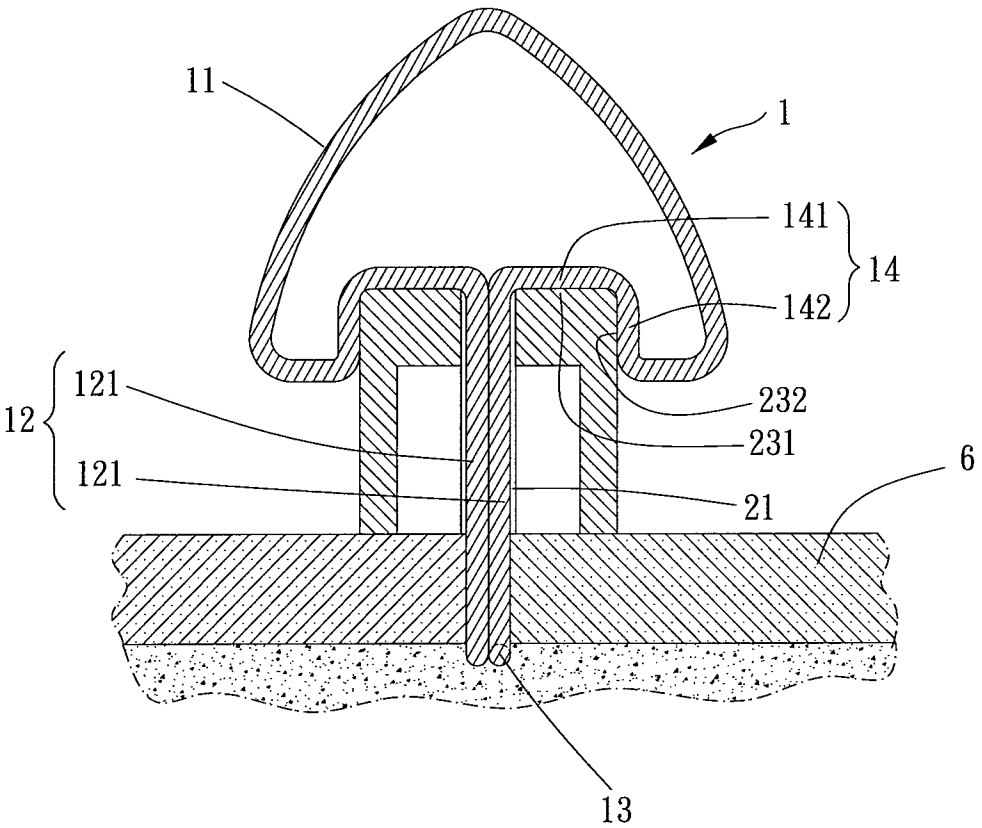
FIG. 6 is a cross-sectional top view of FIG. 5.

The present invention will be clearer from the following description when viewed together with the accompanying drawings, which show, for purpose of illustrations only, the preferred embodiment in accordance with the present invention.

Please refer to FIGS. 1 to 6 for a preferred embodiment of the present invention. A board adjuster includes an adjusting member 1 and a positioning member 2.

The adjusting member 1 includes a toggling portion 11 and an insertion portion 12 which are connected with each other, an end of the insertion portion 12 opposite to the toggling portion 11 has two restricting members 13 which extend toward directions opposite to each other, an end of the toggling portion 11 near the two restricting members 13 has two recessive portions 14, each said recessive portion 14 has a bottom side 141 and a lateral side 142, and the insertion portion 12 is located between two recessive portions 14.

The positioning member 2 has a slot 21, the two recessive portions 14 correspond in shape to an upper portion 230 of the positioning member 2, the positioning member 2 has a top portion 231 and two side walls 232, and the upper portion 230 includes the top portion 231.

The insertion portion 12 is for being inserted into a gap 61 between two boards 6 which are next and parallel to each other, the positioning member 2 is for abutting against and between the two boards 6 and the toggling portion 11, the insertion portion 12 is disposed through the slot 21, the positioning member 2 is disposed through the two recessive portions 14, the top portion 231 abuts against the bottom sides 141 of the two recessive portions 14, and the two side walls 232 respectively abut against the lateral sides 142 of the two recessive portions 14 so that the two restricting members 13 respectively abut against a side of one of the two boards 6 away from the toggling portion 11, and the two restricting members 13 abut the two boards 6 toward the adjusting member 1 and the positioning member 2 so as to adjust an arrangement angle of the two boards 6. In addition, the positioning member 2 and the adjusting member 1 are reusable, so it is environmental-friendly and cost-saving to use the board adjuster.

It is to be noted that the two lateral sides 142 of the adjusting member 1 abut against the two side walls 232 of the positioning member 2, and the two bottom sides 141 abut against the top portion 231; therefore, the two lateral sides 142 can clamp the positioning member 2 to prevent the adjusting member 1 and the positioning member 2 from rotating relative to each other and prevent the adjusting member 1 from tilting relative to the positioning member 2 so that the two restricting members 13 will not be non-parallel to the two boards 6, and the two boards 6 will not tilt.

Specifically, the positioning member 2 has a bottom portion 22, the bottom portion 22 is for abutting against the two boards 6, the bottom portion 22 and the top portion 231 have an included angle therebetween, and the slot 21 penetrates through the top portion 231 and the bottom portion 22.

Figure 7:
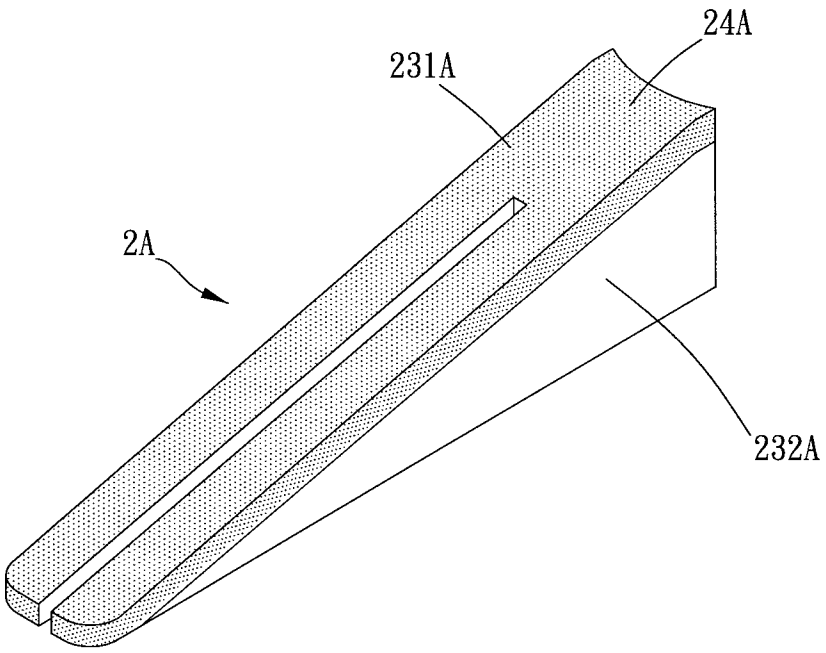
FIG. 7 is a stereogram of another mode of the preferred embodiment of the present invention.

Preferably, a surface of the top portion 231 has an anti-slip portion 24, and the anti-slip portion 24 is an uneven surface to increase a friction of the top portion 231 and the toggling portion 11 abutting against each other so as to prevent the positioning member 2 and the adjusting member 1 from sliding randomly; therefore, a pressure of the two restricting members 13 abutting against the two boards 6 can be applied to the two boards 6 effectively. In other embodiments of the present invention, an anti-slip portion 24A of a positioning member 2A extends to two side walls 232A of the positioning member 2A (as shown in FIG. 7) to increase an area of the anti-slip portion 24A of the positioning member 2A so that the positioning member 2A and the adjusting member 1 have stronger friction when contacting each other.

The insertion portion 12 includes two inserting members 121, the two inserting members 121 are integrally connected with the toggling portion 11, and two restricting members 13 are respectively integrally connected with the two inserting members 121. Specifically, the toggling portion 11, the two inserting members 121 and the two restricting members 13 are formed by bending a rod member 3 which is flexible, in this embodiment, the rod member 3 is an iron wire which is elastic (or any elastic wire member), and two ends of the rod member 3 respectively form the two restricting members 13. The adjusting member 1 is integrally formed by bending the rod member 3, so it is cheaper and easier to manufacture the adjusting member 1.

The positioning member 2 has a first end 25 and a second end 26, the positioning member 2 is a wedge block, the positioning member 2 gradually thickens from the first end 25 toward the second end 26, and the slot 21 is open at the first end 25. The positioning member 2 is used to abut against the adjusting member 1 of the inserting member 12 which has different lengths, and the slot 21 is open at the first end 25; therefore, when adjusting the two boards 6, a user only needs to insert the first end 25 of the positioning member between the toggling portion 11 and the two boards 6, and the insertion portion 12 can slide through the first end 25 into the slot 21.

When the two restricting members 13 respectively abut against a side of one of the two boards 6 away from the toggling portion 11 and the two bottom sides 141 abut against the top portion 231, the adjusting member 1 is closer to the second end 26 than the first end 25.

A length ratio of the bottom side 141 and the lateral side 142 is between 2:1 to 1:1, and in this embodiment, the length ratio of the bottom side 141 and the lateral side 142 is 1.5:1 so that the lateral sides 142 of the two recessive portions 14 can stably clamp the two side walls 232 of the positioning member 2.

Figure 8:
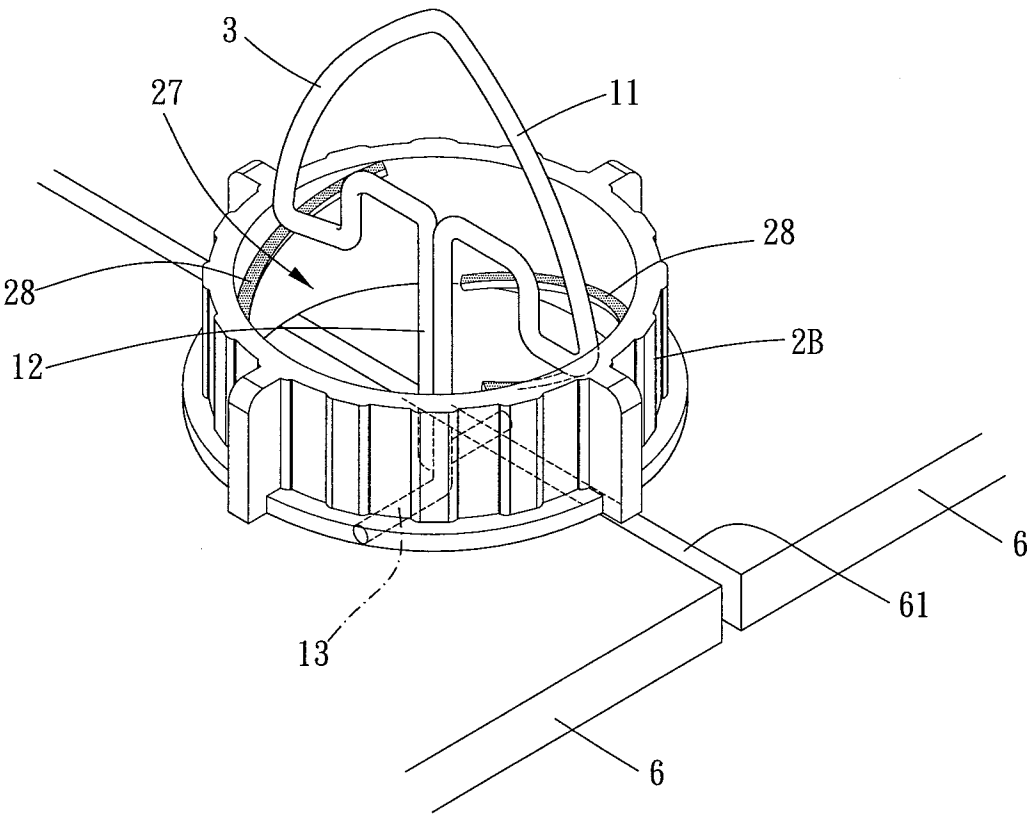
FIG. 8 is a drawing showing another preferred embodiment of the present invention in operation.
Figure 9:
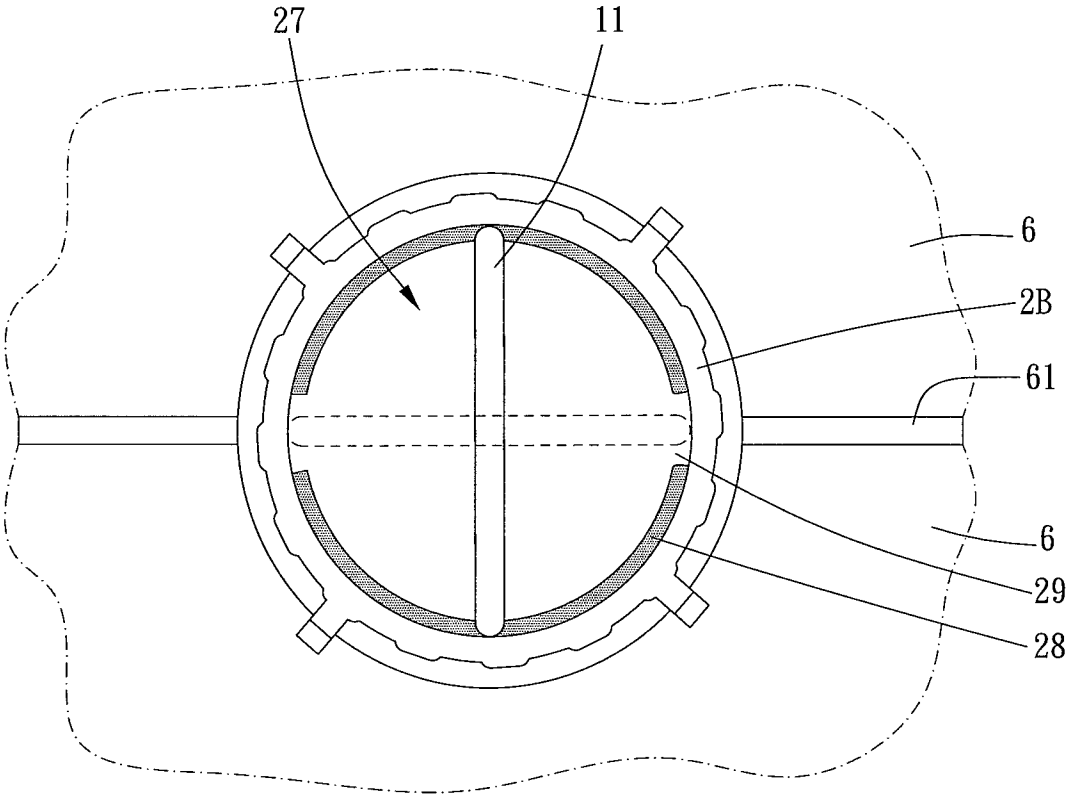
FIG. 9 is a top view showing another preferred embodiment of the present invention in operation.

Please refer to FIGS. 8 and 9 for another embodiment of the present invention. A positioning member 2B has a through hole 27, a wall of the through hole 27 has two extension sections 28 which extend spirally along the wall of the through hole 27, the insertion portion 12 is disposed through the through hole 27, the positioning member 2B is for abutting against the two boards 6, and the two extension sections 28 abut against the toggling portion 11. The two extension sections 28 extend spirally, so the user can rotate the positioning member 2B to make the two extension sections abut against the two toggling portions 11, and the two restricting members 13 are for respectively abutting against a side of one of the two boards 6 away from the toggling portion 11. Specifically, the through hole 27 and the insertion portion 12 are coaxially arranged, the two extension sections 28 have a space 29 therebetween, the toggling portion 11 is axially non-interferable with the space 29, and the two extension sections 28 axially interfere with the toggling portion 11. Therefore, the positioning member 2B can effectively abut against and between the two boards 6 and the toggling portion 11 to adjust the arrangement angle of the two boards 6. More specifically, the through hole 27 and the insertion portion 12 are coaxially arranged, the two extension sections 28 have the space 29 therebetween, the toggling portion 11 is axially non-interferable with the space 29, and the two extension sections 28 axially interfere with the toggling portion 11 so that the toggling portion 11 can be disposed through the space 29 into the positioning member 2B.

Given the above, in the board adjuster, when the positioning member abuts against and between the two boards and the toggling portion, the two restricting members are driven by the toggling portion and the insertion portion to abut against a side of one of the two boards away from each other, and the two restricting members can abut the two boards toward the adjusting member and the positioning member to adjust the arrangement angle of the two boards. In addition, the adjusting member is integrally formed by bending the rod member, so it is cheaper and easier to manufacture the adjusting member; and the positioning member and the adjusting member are reusable, so it is environmental-friendly and cost-saving to use the board adjuster.

While we have shown and described various embodiments in accordance with the present invention, it should be clear to those skilled in the art that further embodiments may be made without departing from the scope of the present invention.

What is claimed is:

1. A board adjuster, including:

an adjusting member, including a toggling portion and an insertion portion which are connected with each other, an end of the insertion portion opposite to the toggling portion having two restricting members which extend toward directions opposite to each other, an end of the toggling portion near the two restricting members having two recessive portions, each said recessive portion having a bottom side and a lateral side, the insertion portion being located between two recessive portions;

a positioning member, having a slot, the two recessive portions corresponding in shape to an upper portion of the positioning member, the positioning member having a top portion and two side walls, the upper portion including the top portion;

wherein the insertion portion is for being inserted into a gap between two boards which are next and parallel to each other, the positioning member is for abutting against and between the two boards and the toggling portion, the insertion portion is disposed through the slot, the positioning member is disposed through the two recessive portions, the top portion abuts against the bottom sides of the two recessive portions, and the two side walls respectively abut against the lateral sides of the two recessive portions so that the two restricting members respectively abut against a side of one of the two boards away from the toggling portion;

wherein the insertion portion includes two inserting members, the two inserting members are integrally connected with the toggling portion, and the two restricting members are respectively integrally connected with the two inserting members;

wherein the toggling portion, the two inserting members and the two restricting members are formed by bending a rod member which is flexible, and two ends of the rod member respectively form the two restricting members.

2. The board adjuster of claim 1, wherein the positioning member has a bottom portion, the bottom portion is for abutting against the two boards, the bottom portion and the top portion have an included angle therebetween, and the slot penetrates through the top portion and the bottom portion.

3. The board adjuster of claim 1, wherein a surface of the top portion has an anti-slip portion, and the anti-slip portion is an uneven surface.

4. The board adjuster of claim 3, wherein the anti-slip portion extends to the two side walls of the positioning member.

5. The board adjuster of claim 1, wherein the positioning member has a first end and a second end, the positioning member is a wedge block, the positioning member gradually thickens from the first end toward the second end, and the slot is open at the first end.

6. The board adjuster of claim 1, wherein the positioning member has a bottom portion, the bottom portion is for abutting against the two boards, the bottom portion and the top portion have an included angle therebetween, the slot penetrates through the top portion and the bottom portion, and when the two restricting members respectively abut against a side of one of the two boards away from the toggling portion and the two bottom sides abut against the top portion, the adjusting member is closer to the second end than the first end.

7. The board adjuster of claim 1, wherein a length ratio of the bottom side and the lateral side is between 2:1 to 1:1.

8. The board adjuster of claim 7, wherein the length ratio of the bottom side and the lateral side is 1.5:1.

* * * * *